United States Patent [19]

Caraher

[11] 4,243,904

[45] Jan. 6, 1981

[54] IMAGE INTENSIFIER TUBE WITH INSULATOR SHIELD

[75] Inventor: James R. Caraher, Stamford, Conn.

[73] Assignee: The Machlett Laboratories, Inc., Stamford, Conn.

[21] Appl. No.: 911,857

[22] Filed: Jun. 2, 1978

[51] Int. Cl.[3] ..... H01J 40/04; H01J 40/02

[52] U.S. Cl. ..... 313/99; 313/101

[58] Field of Search ..... 313/102, 101, 99; 250/213 VT

[56] References Cited

U.S. PATENT DOCUMENTS

| | | | |
|---|---|---|---|
| 2,946,910 | 7/1960 | Spinnler et al. | 313/101 |
| 3,280,356 | 10/1966 | Stoudenheimer et al. | 313/99 |
| 4,087,683 | 5/1978 | Lieb | 313/102 |

OTHER PUBLICATIONS

Bolin et al., "A Review of Dielectra Media-Vacuum Insulation," Insulator/Circuits; Sep., 1970; pp. 59-65.

Finke, "A Study of Parameters Affecting the Maximum Voltage Capabilities of Shielded Negative Dielectric Junction Vacuum Insulators;" Proceedings of the Second International Symposium on Insulation of High Voltages in Vacuum; MIT; Boston; Sep., 1968; pp. 217-228.

Kofoid, "Effect of Metal-Dielectric Junction Phenomena on High Voltage Breakdown over Insulators in Vacuum;" Transactions of AIEE, USC; Part III, 79, 1960; pp. 999-1004.

Shannon et al.; "Insulation of High Voltage Across Solid Insulators in Vacuum;" Journal of Vacuum Science and Technology; vol. 2, No. 5; Sep.-Oct. issues 1965; pp. 234-239.

*Primary Examiner*—Robert Segal

*Attorney, Agent, or Firm*—John T. Meaney; Joseph D. Pannone

[57] ABSTRACT

An image intensifier tube comprising an evacuated envelope wherein two spaced electrodes are insulatingly secured to one another by a dielectric member having an end portion extended within closely spaced walls of a hollow conductive shielding means attached to one of the electrodes for protecting the end portion from conductive vaporous material released within the envelope during processing and from resulting voltage breakdown during operation of the tube.

9 Claims, 4 Drawing Figures

IMAGE INTENSIFIER TUBE WITH INSULATOR SHIELD

BACKGROUND OF THE INVENTION

1. Field of the Invention

This invention relates generally to light amplifier tubes, and is concerned more particularly with an image intensifier tube having shielding means for protecting dielectric members during processing and operation of the tube.

2. Discussion of the Prior Art

Generally, an image intensifier tube comprises an evacuated envelope having therein an input screen aligned with a spaced output screen. The input screen, in response to an incident radiational image, emits an equivalent electron image which is electrostatically accelerated to impinge on the output screen with sufficient kinetic energy for producing a corresponding visual image. Consequently, there may be disposed between the input and output screens a coaxial series of spaced grid electrodes which are maintained at suitable electrical potentials for focusing the electron image onto the output screen. Adjacent grid electrodes may be insulatingly secured to one another by interposed dielectric spacers having respective portions attached to the electrodes.

The input screen may include a scintillator layer of fluorescent material disposed on a radiation transmissive substrate which is mounted in the input end portion of the envelope during assembly of the tube. Also, the input screen comprises a photocathode layer of conductive photoemissive materials, which may be vapor deposited on the scintillator layer during processing of the tube. However, it has been found that during deposition of the photocathode layer, vaporous photoemissive materials also may migrate to the dielectric spacers and condense on the surfaces thereof. Consequently, during subsequent operation of the tube, this condensed photoemissive material may provide leakage paths whereby flashover may occur across the dielectric spacers and result in voltage breakdown of the tube.

Therefore, it is necessary and desirable to provide an intensifier tube with shielding means for protecting dielectric members during processing and avoiding voltage breakdown during subsequent operation of the tube.

SUMMARY OF THE INVENTION

Accordingly, this invention provides an image intensifier tube including an evacuated envelope having therein first and second electrodes insulatingly secured to one another through a dielectric spacer having an end portion protected by an encircling hood made of conductive material. The protected end portion of the spacer is secured to the first electrode through an interposed closed end of the hood electrically connected to the electrode. The spacer extends in close spaced relationship with the encircling wall of the hood and protrudes out of an open end thereof, which is provided with an outwardly curled rim. The other end portion of the spacer is unprotected by the hood and is attaced to the second electrode.

The spacing between the protected end portion of the spacer and the encircling wall of the hood is in the range of three thousands to one hundred thousands of an inch, for example, and preferably is in the range of twenty to forty thousands of an inch. Consequently, the protected end portion of the spacer and the encircling wall of the hood define an interposed narrow cavity means for limiting intrusion therein of vaporous conductive material and adjacent electrostatic fields. Also, the encircling wall of the hood may extend along the length of the spacer to a distance of about one hundred thousands of an inch from the other electrode, for example. In this manner, the interposed narrow cavity may be provided with sufficient depth to ensure that intruding vaporous conductive material and adjacent electrostatic fields will not reach the closed end of the cavity. Thus, the hood constitutes an conductive hood shielding means for protecting an enclosed portion of a dielectric spacer means from conductive vaporous material and adjacent electrostatic fields.

In a preferred embodiment of the image intensifier, the first and second electrodes may comprise first and second grid electrodes disposed adjacent aligned input and output screens, respectively, within the evacuated envelope. The first and second grid electrodes are insulatingly secured to one another through cylindrical dielectric spacer means disposed axially therebetween. Thus, the cylindrical spacer means may comprise, for example, an annular array of spaced posts made of dielectric material and having opposing end portions attached to the first and second grid electrodes, respectively. Alternatively, the cylindrical spacer means may comprise a hollow dielectric cylinder having opposing end surfaces secured to the first and second grid electrodes, respectively. The conductive hood means may comprise a plurality of conductive cups, each having extended therein an end portion of a respective one of the dielectric posts, or may comprise a conductive ring having disposed in an end surface thereof an open-ended annular cavity wherein an end portion of the dielectric cylinder extends.

One end portion of the dielectric spacer means is secured through the closed end of the conductive hood shielding means to the first grid electrode, which is disposed adjacent the input screen and usually is maintained at a lower operating potential than the second grid electrode. As a result, the conductive hood means has a closed end directed toward the input screen, where sources of vaporized photoemissive material generally are located during processing of the tube, and has an opposing open end directed away therefrom. Thus, the vaporized photoemissive material is required to travel a tortuous rather than a direct line-of-sight path in order to enter the conductive hood shielding means. Also, the closed end of the hood shielding means is disposed between the dielectric spacer means and the more negative one of the interconnected grid electrodes where voltage breakdown is more apt to occur due to high electrostatic field gradients. Accordingly, the conductive hood means enclosing the end portion of the dielectric spacer means adjacent the input screen serves the dual purpose of protecting the end portion of the spacer means from conductive vaporous material, which may condense thereon and from leakage paths, and shielding the end portion of the spacer means from high electrostatic field gradients, which may initiate voltage breakdown.

BRIEF DESCRIPTION OF THE DRAWINGS

For a better understanding of the invention, reference is made in the following more detailed description to the accompanying drawing wherein.

DESCRIPTION OF THE PREFERRED EMBODIMENT

Figure 1:
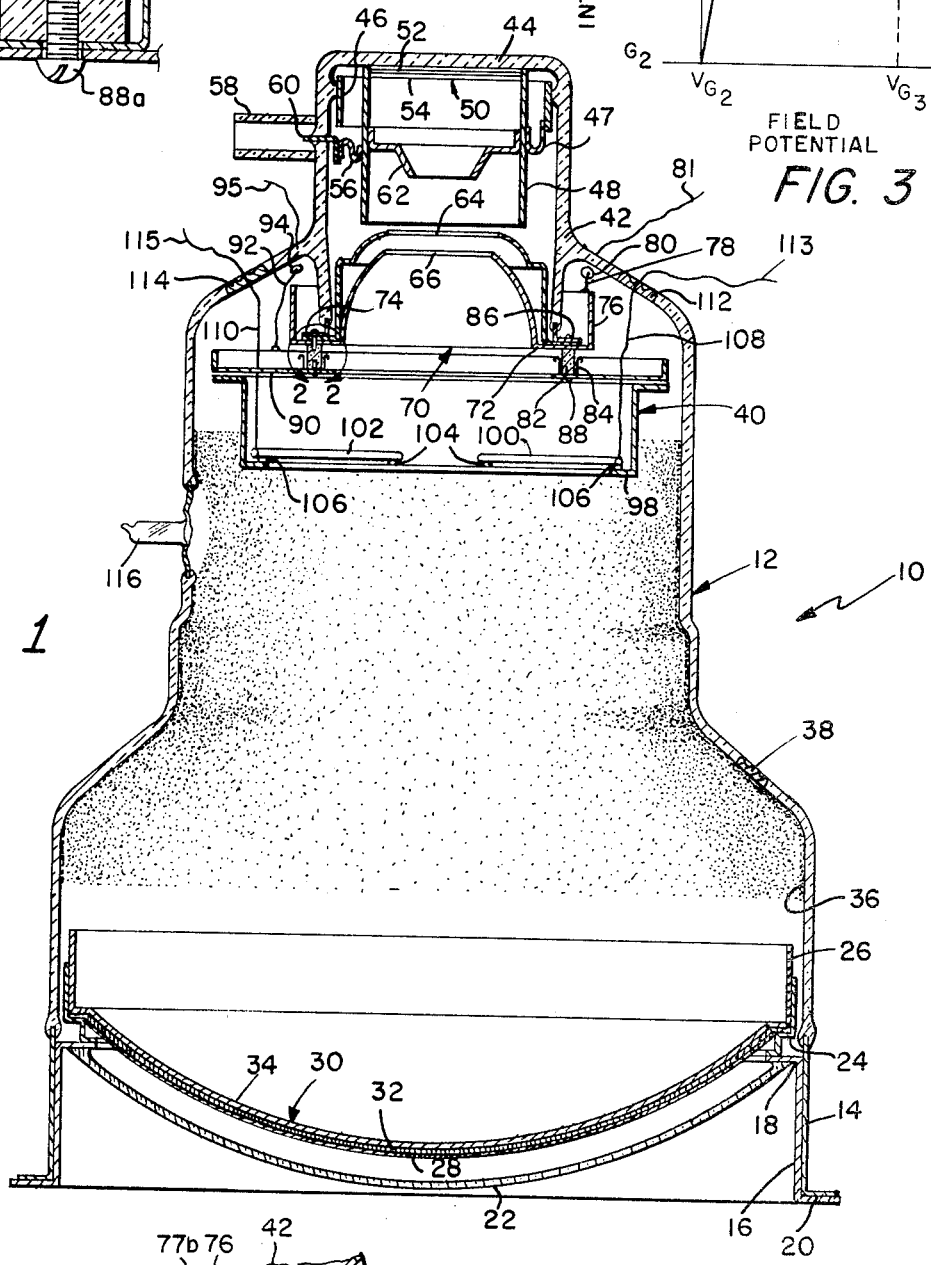
FIG. 1 is an axial sectional view of an image intensifier tube embodying the invention.

Referring to the drawing, there is shown in FIG. 1 an image intensifier tube 10 comprising an evacuated tubular envelope 12 which may have an intermediate diameter portion made of dielectric vitreous material, such as glass, for example. The intermediate diameter portion may be integrally joined through an outwardly flared portion to a larger diameter vitreous portion of envelope 12. The larger diameter vitreous portion may be peripherally sealed by well-known means to an adjacent end portion of an aligned cathode sleeve 14 made of electrically conductive material, such as Kovar, for example. Sleeve 14 has an opposing end portion extended outwardly and circumferentially attached by conventional means to a juxtaposed end portion of an encircled collar 16. The juxtaposed and attached end portions of sleeve 14 and collar 16, respectively, constitute a cathode terminal flange 20 disposed at the larger diameter end of tube 10.

Collar 16 is made of electrically conductive material, such as Kovar, for example, and has an opposing end portion 18 extended inwardly of envelope 12. The end portion 18 has an annular surface sealed by well-known means to an outer peripheral portion of a dome-like faceplate 22 having a convex outer surface and a concave inner surface. Faceplate 22 closes the input end of envelope 12 and is made of radiation transmissive material, such as lead-free glass, for example. Alternatively, the input faceplate 22 may be made of optical fiber rods sealed in side-by-side relationship, and may be provided with any suitable configuration, such as having a concave inner surface and a planar outer surface, for example.

The opposing surface of end portion 18 is attached to a flanged end portion of a stepped support annulus 24 which is made of electrically conductive material, such as aluminum, for example. Annulus 24 has an opposing end portion extended longitudinally of envelope 12 and secured to an encircled wall portion of a ring 26 made of conductive material, such as aluminum, for example. Clamped between an intermediate shoulder portion of annulus 24 and a flanged rim of ring 26 is an outer peripheral portion of a thin substrate 28 made of radiation transmissive material, such as aluminum, for example. Substrate 28 may be provided with a dome-like configuration having a curvature conforming substantially to the curvature of input faceplate 22, and may be supported in spaced axial alignment therewith.

Disposed on the inner surface of substrate 28 is an input screen 30 which may comprise a scintillator layer 32 of fluorescent material, such as cesium iodide doped with sodium or thallium, for example, and an overlying photocathode layer 34 of photoemissive material, such as cesium antimonide, for example. Alternatively, the input screen 30 may be disposed on the inner surface of input faceplate 22, which may require an interposed radiation transmissive layer (not shown) of mutually compatible material, such as aluminum, for example. The photocathode layer 34 of input screen 30 is electrically connected through the support annulus 24 and collar 16 to cathode terminal flange 20, whereby the photocathode layer may be maintained at a desired electrical potential during operation of tube 10.

Axially spaced from the ring 26 is an adjacent end portion of a first grid electrode 36 comprising a hollow cylinder of conductive material, such as aluminum, for example, which may conveniently may be deposited in a thin layer on the inner cylindrical surface of envelope 12. The electrode 36 extends axially and annularly along the larger diameter vitreous portion of envelope 12 and onto the adjacent flared portion thereof where it may be electrically connected to a terminal button 38 sealed in the wall of the envelope. Electrode 36 also extends axially and annularly along the outwardly flared portion of envelope 12 and into the intermediate diameter portion thereof to terminate in spaced encircling relationship with an adjacent end portion of a second grid electrode 40. The terminal button 38 may be connected electrically to an external conductor whereby the first grid electrode 38 may be maintained at a desired electrical potential during operation of tube 10.

The intermediate diameter portion of envelope 12 may be integrally joined at its other end to an inwardly flared portion which is peripherally sealed by well-known means to a cylindrical wall 42 of a small diameter end portion of the envelope. The cylindrical wall 42 has an end portion extended longitudinally within envelope 12, and has an opposing outer end portion closed by an integral output faceplate 44 made of light transparent material, such as glass, for example. Adjacent the inner surface of output faceplate 44, the cylindrical wall 42 is attached by well-known means to an axially disposed ring 46 made of suitable material, such as Kovar, for example. The ring 46 encircles an axially disposed anode sleeve 48 having an adjacent end abutting the inner surface of faceplate 44 and having an opposing entrance end. Anode sleeve 48 is maintained in the desired positional relationship with respect to output faceplate 44 by suitable means, such as a circular array of spaced loop springs 47 having respective end portions attached to the anode sleeve 48 and respective other end portions engaged in aligned slots (not shown) in the ring 46, for example.

The anode sleeve 48 is made of electrically conductive material, such as stainless steel, for example, and supports adjacent the inner surface of faceplate 44 an aligned output screen 50. Output screen 50 includes a phosphor layer 52 of material sensitive to impinging electrons, such as silver activated zinc cadmium sulfide, for example, and an overlying light reflective layer 54 of electrically conductive material, such as aluminum, for example. The light reflective layer 54 connects the output screen 50 electrically to the anode sleeve 48, which is connected electrically through an attached flexible conductor 56 to an anode terminal 60 sealed in the cylindrical wall 42. An external portion of terminal 60 may be encircled by a protective tubulation 58 made of suitable material, such as glass, for example, for attaching an end portion thereof by conventional means to the cylindrical wall 42. Thus, the external portion of anode terminal 60 provides means for maintaining the anode sleeve 48 and electrically connected components, such as input screen 50, for example, at a desired electrical potential during operation of tube 10.

Between the end portion of anode sleeve 46 closed by output screen 50 and the opposing open end of anode sleeve 48, there may be attached to the inner cylindrical surface thereof an axially disposed, focusing annulus 62. The annulus 62 is made of electrically conductive material, such as stainless steel, for example, and preferably is provided with a frusto-conical configuration having the smaller diameter end portion directed toward the open end of anode sleeve 48. Disposed adjacent the open end of anode sleeve 48 and axially spaced therefrom is an aligned aperture 64 of relatively smaller diameter, which is axially spaced from an aligned aperture 66 of similar diametric size. The apertures 64 and 66 are centrally disposed in inwardly curved end portions of outer and inner walls, respectively, of a generally bowl-shaped electrode 70 which has an opposing open end defining an entrance aperture of relatively larger diameter. The electrode 70 is made of electrically conductive material, such as stainless steel, for example, and constitutes the third grid electrode of tube 10.

At the larger diameter end of electrode 70, the outer and inner walls thereof have respective outwardly extended portions attached to one another and constitute a substantially flat rim portion 72 of the electrode. Rim portion 72 overlies the inner end portion of cylindrical wall 42 and is secured thereto by an interposed support flange 74 made of suitable material, such as Kovar, for example. The support flange 74 has a longitudinally extended end portion joined by well-known means to the inner end portion of wall 42, and has a right-angled end portion fastened by conventional means to the rim portion 72. Extending longitudinally from the outer periphery of rim portion 72 is an annular skirt 76 which protectively encircles the glass-to-metal joint between support flange 74 and the inner end portion of wall 42. The skirt 76 is electrically connected through an attached conductor 78 to a terminal button 80 sealed in the inwardly flared portion of envelope 12. Terminal button 80 may be electrically connected to an external conductor, such as 81, for example, thereby providing means for maintaining the third grid electrode 70 at a desired electrical potential during operation of tube 10.

Figure 2:
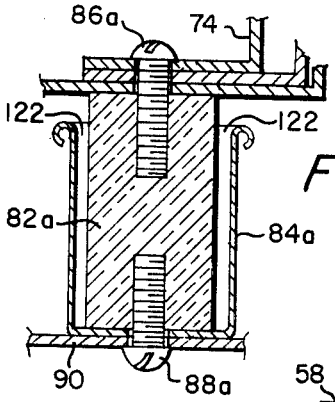
FIG. 2 is an enlarged fragmentary axial view of one embodiment of the shielded dielectric spacer means shown within the arcuate line 2—2 in FIG. 1.

Second grid electrode 40 is made of electrically conductive material, such as stainless steel, for example, and is insulatingly secured to third grid electrode 70 through a dielectric spacer means 82 provided with hooded shielding means 84. As shown in FIG. 2, the spacer means 82 may comprise a plurality of annularly spaced posts **82*a* made of dielectric material, such as ceramic, for example, and disposed lonitudinally of envelope 12. Each of the posts 82*a* may have a respective unprotected end portion drawn into abutting relationship with the rim portion 72 by a fastening device, such as machine screw 86*a*, for example, which extends axially through aligned apertures in support flange 74 and rim portion 72 for journalling into a threaded cavity in the adjacent end portion of the post 82*a***.

Opposing end portions of the posts **82*a* are protected by a conductive hood shielding means 84 which may comprise respective cups 84*a* loosely fitted over protected end portions of the posts 82*a* and made of electrically conductive material, such as stainless steel, for example. Each of the cups 84*a* has a cylindrical wall disposed in close spaced encircling relationship with the protected end portion of the respective post 82*a* and terminates at the open end of the cup in an outwardly curled rim. The closed ends of the cups 84*a* are urged into interfacing relationship with the adjacent end surfaces of the respective posts 82*a* and into electrical engagement with an annular plate 90 of second grid electrode 40 by suitable fastening means, such as screws 88*a*, for example. The screws 88*a* may be passed axially through aligned apertures in the plate 90 and in the closed ends of respective cups 84*a* for journalling into threaded cavities in the protected end portions of the posts 82*a***.

Figure 4:
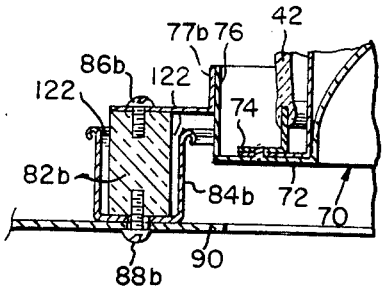
FIG. 4 is an enlarged fragmentary axial view of an alternative embodiment of the shielded dielectric spacer means shown within the arcuate line 2—2 in FIG. 1.

Alternatively, as shown in FIG. 4, the skirt 76 may have attached to outer surface thereof an outwardly extended, annular tab **77*b* made of conductive material, such as stainless steel, for example. The spacer means 82 may comprise a hollow cylinder 82*b* made of dielectric material, such as ceramic, for example, and disposed axially of envelope 12. Cylinder 82*b* may have an unprotected end portion drawn into abutting relationship with the tab 77*b* by suitable fastening means, such as a plurality of annularly spaced screws 86*b*, for example, which are passed axially through aligned apertures in the tab 77*b* and are journalled into respective cavities in the adjacent end portion of the cylinder 82*b*. The opposing annular end portion of cylinder 82*b* is protected by a hood shielding means 84 comprising a cup-shaped ring 84*b* loosely fitted over the protected end portion and made of electrically conductive material, such as stainless steel, for example. The ring 84*b* has inner and outer cylindrical walls disposed in close spaced coaxial relationship with the protected end portion of cylinder 82*b*, and terminate at the open end of the ring in respective inwardly and outwardly curled rims. The closed end of ring 84*b* is drawn into interfacing relationship with the adjacent end surface of the cylinder 82*b* and into electrical engagement with the annular plate 90 of second grid electrode 40 by suitable fastening means, such as a plurality of annularly spaced screws 88*b*, for example. The screws 88*b* are passed axially through aligned apertures in the plate 90 and are journalled into respective cavities in the adjacent end portion of cylinder 82*b***.

The plate 90 defines a central exit aperture which is aligned with the adjacent entrance aperture of third grid electrode 70 and has a slightly larger diameter. Plate 90 extends radially outward from the central exit aperture and has an outer peripheral portion attached to a shouldered end portion of second grid electrode 40. The shouldered end portion is electrically connected through a conductor 92 to a terminal button 94 sealed in the inwardly flared portion of envelope 12. Terminal button 94 may be electrically connected to an external conductor, such as 95, for example, thereby providing means for maintaining the second grid electrode 40 at a desired electrical potential during operation of tube 10.

The other end portion of second grid electrode 40 terminates in an inwardly extended flange 98 which defines an entrance aperture aligned with the exit aperture defined by plate 90 and has a larger diameter. Underlying flange 98 is a plurality of arcuate channel members, such as 100 and 102, for example, which are made of electrically conductive material, such as stainless steel, for example. The channel members 100 and 102 have respective end portions electrically attached to the flange 98 by conductive support posts 104, and respective other end portions insulatingly attached to flange 98 by dielectric support posts 106. The insulated end portions of channel members 100 and 102 are electrically connected through respective attached conductors 108 and 110 to terminal buttons 112 and 114 respectively, sealed in the inwardly flared portion of envelope 12. Terminal buttons 112 and 114 may be connected to respective external conductors 113 and 115 for heating the channel members 100 and 102 electrically when desired. Adjacent the flange 98, there is sealed in a wall portion of envelope 12 an exhaust tubulation 116 made of a material, such as copper, for example, which may be hermetically sealed-off, as by crimping, for example, when evacuation of the tube 10 is completed.

The channel members 100 and 102 may comprise respective hollow tubings having closed ends and provided with overlapping longitudinal edge portions whereby gaseous vapors generated by electrical heating may escape therefrom. Each of the channel members 100 and 102 may be filled with a suitable material for vapor depositing the photocathode layer 34 on the inner surface of scintillator layer 32 during processing of tube 10. Thus, the channel member 100 may be filled with cesium liberating powder material, such as cesium chromate, for example; and the channel member 102 may be filled with an antimony liberating powder material, such as substantially pure antimony, for example. Alternatively, as disclosed in copending U.S. Pat. application Ser. No. 784,207 filed on Apr. 4, 1977 and assigned to the assignee of this invention, the channel member 102 may be filled with an oxygen liberating material, such as manganese dioxide powder material, for example. Also, the antimony liberating material, for example, may be introduced into envelope 12 during processing of tube 10 by means of an electrically heated boat (not shown) passed through the exhaust tubulation 116 and withdrawn when vapor depositing of photocathode layer 34 is completed.

In the assembly of tube 10, the scintillator layer 32 of input screen 30 may be disposed, as by vapor deposition, for example, on the inner surface of substrate 28 externally of envelope 12, such as in a bell jar, for example. The substrate 28 bearing the scintillator layer 32 is mounted between the ring 26 and support annulus 24, which is attached to the collar 16 carrying the input faceplate 14. However, while the input end of envelope 12 is open, the other components of tube 10 may conveniently be installed within the envelope through the larger diameter end portion thereof. Then, the input end of envelope 12 is closed by sliding collar 16, with the attached input components, into the cathode sleeve 14 and hermetically attaching the outwardly extended end portions thereof to form the cathode terminal flange 20.

During processing, the assembled tube 10, minus the photocathode layer 34 of input screen 30, may be connected to an exhaust system (not shown) by means of exhaust tubulation 116 for evacuation and bakeout. Then, an electrical heating current may be passed through one or both of the channel members 100 and 102, respectively, to cause vaporization of the powder material therein. As a result, vaporous conductive material, such as cesium and antimony, for example, is released within envelope 12 to deposit on the inner surface of scintillator layer 32 and form the overlying photocathode layer 34. However, molecules of the vaporous conductive material also may migrate within envelope 12 to deposit on exposed surface areas of the dielectric spacer means 82. Thus, unless restricted in some manner, the conductive material deposited on dielectric spacer means 82 may cause arc-over and possibly voltage breakdown to occur between the second and grid electrodes, 40 and 70, respectively during the operation of the tube.

Consequently, in the image intensifier tube 10, the dielectric spacer means 82 has an end portion adjacent the second grid electrode 40 protected from the vaporous conductive material by the conductive hood shielding means 84. The closed end of the hood shielding means 84 interfaces with the adjacent end surface of the dielectric spacer means 82 and is directed toward the source of vaporous conductive material. Extended axially from the closed end of hood shielding means 84 are cylindrical wall portions thereof which are radially spaced from the protected end portion of the dielectric spacer means 82. The radial spacing of the cylindrical wall portions of the hood shielding means 84 from the protected end portion of the dielectric spacer means 82 is in the range of about three thousands to about one hundred thousands of an inch, for example, and preferably is in the range of about twenty to about forty thousands of an inch. Also, the cylindrical wall portions of the hood shielding means 84 may extend axially from the closed end thereof to a distance of about one hundred thousands of an inch, for example, from the opposing unprotected end surface of dielectric spacer means 82. Adjacent the third grid electrode 70, the hood shielding means 84 terminates in an open end directed away from the source of vaporous conductive material, and defined by an outwardly curled rim portion. The rim portion of the hooded shielding means 84 has a curvature which minimizes the development of adjacent high field gradients during operation of tube 10.

Thus, between the cylindrical wall portions of the hood shielding means 84 and the protected end portion of dielectric spacer means 82, there is provided a narrow space 122 having a closed end adjacent second grid electrode 40 and an opposing open end adjacent the third grid electrode 70. The narrow space 122 is dimensioned to ensure that the mean free path of intruding molecules of vaporous conductive material is much less than the depth of the space 122. Consequently, any vaporous conductive material entering the space 122 is more apt to condense on the defining wall surfaces adjacent to open end thereof than to penetrate a substantial distance into the space 122. As a result, the vaporous conductive material is restricted from contacting the end portion of dielectric spacer means 82 adjacent the closed end of the hooded shielding means 84.

In operation, the input screen 30, which may be maintained at electrical ground potential, for example, receives an incident radiational image and emits an equivalent electron image. The output screen 50 may be maintained at a high positive potential relative to the input screen 30, such as twenty-five thousand volts, for example, to electrostatically accelerate the emitted electron image toward the output screen. Intermediate grid electrodes 36, 40, and 70, respectively, are maintained at suitable electrical potentials relative to the input screen 30 for focusing the emitted electron image onto the smaller diameter output screen 50. Accordingly, the first grid electrode may be maintained at an electrical potential of about three hundred and fifty volts, for example; the second grid electrode may be maintained at an electrical potential in the range of about fifteen hundred to about two thousand volts, for example; and the third grid electrode may be maintained at an electrical potential in the range of about thirty-five hundred to about forty-five hundred volts, for example. Consequently, there may be established between the second and third grid electrodes, 40 and 70, respectively, an electrostatic field whicy may cause electron emission to occur at an unshielded end surface of a dielectric spacer means interfacing with the second grid electrode 40. As a result, flash-over and possibly voltage breakdown may occur between the second and third grid electrodes, 40 and 70, respectively.

Figure 3:
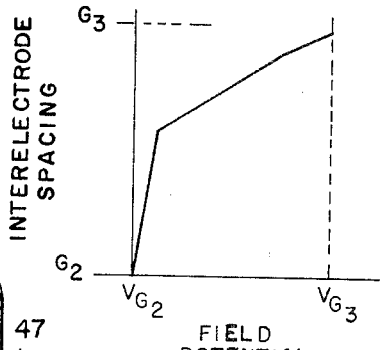
FIG. 3 is a graphical view of the electrostatic shielding provided by the shielding means shown in FIG. 2.

However, in the operation of image intensifier tube 10, the described adverse effects of the electrostatic field may be prevented by the conductive hood shielding means 84 protecting the end portion of dielectric spacer means 82 adjacent the second grid electrode 40. In FIG. 3, the potential of the electrostatic field with respect to the potential of second grid electrode 40 is plotted as a function of the axial distance along the dielectric spacer post 82*a* shown in FIG. 2. A comparison of FIG. 3 with FIG. 2 indicates that the potential of the electrostatic field decreases progressively in the axial distance from third grid electrode 70 to the open end portion of conductive cup 84*a*. In the remaining axial distance along dielectric spacer post 82*a*, the potential of the electrostatic field falls off sharply to substantially a zero value adjacent the second grid electrode 40.

Thus, by having the cylindrical wall portion of cup 84*a* disposed sufficiently close to the encircled portion of dielectric post 82*a*, the cup 84*a* is provided with an open end portion of suitable diametric size for restricting the pentration therein of the adjacent electrostatic field. Also, the cylindrical wall portion extends axially along the dielectric spacer post 82*a* sufficiently to provide the cup 84*a* with a cavity having a substantially field-free region adjacent the closed end thereof. Accordingly, the closed end of cup 84*a* is electrically attached to the second grid electrode 40 and disposed in interfacing relationship with the adjacent end surface of the dielectric spacer post 82*a* to protect it from the adjacent electrostatic field.

Thus, there has been disclosed herein an image intensifier having an evacuated envelope wherein two electrodes are insulatingly attached to one another through a dielectric spacer means 82 having an end portion protected by a conductive hood shielding means 84 from vaporous conductive material released within the envelope during processing of the tube and from adjacent electrostatic fields during operation of the tube.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted in an illustrative rather than in a restrictive sense.

What is claimed is:

1. An image intensifier tube comprising:

an evacuated envelope;

tubular means in the envelope for supporting therein a source of vaporous conductive material;

electrode means in the envelope including a first electrode disposed adjacent the tubular means and an axially spaced second electrode for establishing adjacent electrostatic fields;

dielectric spacer means having first portions connected to the first electrode and second portions attached to the second electrode for insulatingly securing the electrodes to one another; and cup-shaped conductive hood shielding means electrically connected to the first electrode and disposed about the first portions of the dielectric spacer means for protecting the first portions from the vaporous conductive material and the adjacent electrostatic fields, the cup-shaped conductive hood shielding means including closed end portions disposed in interfacing relationship with the first portions and having extended therefrom wall portions laterally spaced from the first portions and terminating in open end portions outwardly curled rims.

2. An image intensifier tube as set forth in claim 1 wherein the closed end portions of the conductive hood shielding means are directed toward the tubular means and the open end portions are directed away therefrom.

3. An image intensifier tube as set forth in claim 1 wherein the wall portions of the conductive hood shielding means are laterally spaced from the first portions of the dielectric spacer means a distance in the range of about three thousands of an inch to about one hundred thousands of an inch.

4. An image intensifier tube as set forth in claim 1 wherein the wall portions of the conductive hood shielding means terminate no closer than one hundred thousands of an inch from the second electrode.

5. An image intensifier tube as set forth in claim 1 wherein the dielectric spacer means and the conductive hood shielding means are cylindrical and axially disposed with respect to the first and second electrodes.

6. An image intensifier tube as set forth in claim 5 wherein the wall portions of the conductive hood shielding means are disposed in spaced coaxial relationship with the first portion of the dielectric spacer means.

7. An image intensifier tube as set forth in claim 6 wherein the wall portions of the conductive hood shielding means are radially spaced from the first portions a distance in the range of about twenty thousands of an inch to about forty thousands of an inch.

8. An image intensifier tube as set forth in claim 6 wherein the dielectric spacer means comprises an annular array of spaced posts made of dielectric material, and the conductive hood shielding means comprises respective cups made of electrically conductive material.

9. An image intensifier tube as set forth in claim 6 wherein the dielectric spacer means comprises a ring of dielectric material, and the conductive hood shielding means comprises a cup-shaped ring made of electrically conductive material.

* * * * *

UNITED STATES PATENT OFFICE

CERTIFICATE OF CORRECTION

Patent No. 4,243,904 Dated January 6, 1981

Inventor(s) James R. Caraher

It is certified that error appears in the above-identified patent and that said Letters Patent are hereby corrected as shown below:

Column 2, line 12, change "an" to --a--.

line 60, change "from" to --form--.

Column 9, line 1, change "whicy" to --which--.

Signed and Sealed this

*Twenty-fifth* Day of *August 1981*

[SEAL]

*Attest:*

GERALD J. MOSSINGHOFF

*Attesting Officer* *Commissioner of Patents and Trademarks*